United States Patent [19]

Brock

[11] Patent Number: 4,715,720

[45] **Date of Patent: * Dec. 29, 1987**

[54] DRUM MIX ASPHALT PLANT WITH KNOCK-OUT BOX AND SEPARATE PUGMILL COATER

[75] Inventor: J. Donald Brock, Chattanooga, Tenn.

[73] Assignee: Astec Industries, Inc., Chattanooga, Tenn.

[ * ] Notice: The portion of the term of this patent subsequent to Oct. 14, 2003 has been disclaimed.

[21] Appl. No.: 882,294

[22] Filed: Aug. 18, 1986

Related U.S. Application Data

[63] Continuation of Ser. No. 668,290, Nov. 5, 1984, Pat. No. 4,616,934.

[51] Int. Cl.[4] ..... B28C 5/46

[52] U.S. Cl. ..... 366/25; 366/22; 366/40

[58] Field of Search ..... 366/1–5, 366/10–12, 22–25, 27, 28, 40, 42, 45, 47, 14, 15, 53, 137, 138; 422/106; 34/132

[56] References Cited

U.S. PATENT DOCUMENTS

| | | | |
|---|---|---|---|
| 2,028,745 | 1/1936 | Hendrick et al. | 366/15 |
| 2,146,405 | 2/1939 | Overman | 366/22 |
| 3,809,373 | 5/1974 | Brock | 366/22 X |
| 4,211,490 | 7/1980 | Brock et al. | 366/25 X |
| 4,298,287 | 11/1981 | McCarter, III et al. | 366/25 X |
| 4,616,934 | 10/1986 | Brock | 366/4 |

*Primary Examiner*—Timothy F. Simone

*Attorney, Agent, or Firm*—Jones, Askew & Lunsford

[57] ABSTRACT

Asphalt plant apparatus comprising a drum dryer, a collection chamber or "knock-out box," a "baghouse," and a separate pugmill coater disposed directly underneath the collection chamber so that dust particles which settle out of the airstream in the collection chamber fall directly into the pugmill coater. The apparatus solves the problem of light-end hydrocarbon pollutants which can be stripped from liquid asphalt by contact with steam, in that the liquid asphalt is introduced not into the drum dryer but into the separate pugmill coater instead. Since no liquid asphalt is present in the drum dryer to coat and control the aggregate dust, the exhaust air from the dryer is more heavily dust-laden than that from a conventional drum mixer. However, the apparatus utilizes a collection chamber to compensate for the additional dust in the exhaust air by recovering part of that dust and dropping it directly into the pugmill coater, where it is mixed with the aggregate and liquid asphalt.

3 Claims, 7 Drawing Figures

DRUM MIX ASPHALT PLANT WITH KNOCK-OUT BOX AND SEPARATE PUGMILL COATER

Cross-Reference to Related Applications

This application is a continuation of my prior application Ser. No. 5, 1984, now U.S. Pat. No. 4,616,934.

TECHNICAL FIELD

This invention relates in general to apparatus for the manufacture of asphalt aggregate material, and in particular to asphalt plant apparatus having a drum dryer and a separate pug-mill coater disposed directly underneath a "knock-out" box so as to cause aggregate dust to drop directly into the coater.

BACKGROUND ART

Drum mixing apparatus is widely known in the art for use in preparing asphalt aggregate paving compositions. A typical drum mixing apparatus includes a drying zone wherein virgin aggregate is dried by agitating the aggregate in a flow of heated air; and a mixing zone wherein the aggregate material and any reclaimed roadway materials being recycled are mixed with liquid asphalt to form the desired mixture.

Drum mixers are generally recognized as having certain advantages in comparison to other types of asphalt plants, including continuous flow operation and relative portability for transportation between job locations. However, drum mixers produce unwanted by-products in the form of liquid asphalt vapors and airborne aggregate dust, which, as will be further explained, lead to the problems of oil accumulations in baghouses, baghouse fires, and opacity problems that result in failure to meet air pollution codes.

During the conventional asphalt-mixing process, the agitation of aggregate in a mixing drum during the drying process produces a high level of airborne aggregate dust. To control this dust, liquid asphalt has been introduced into the drum mixer to coat the dust and prevent it from becoming airborne. However, the introduction of liquid asphault into the heated mixing drum produces liquid asphalt vapors comprising light end hydrocarbons which are stripped from liquid asphalt upon exposure to the steam and high temperatures present in the drum mixer. In the course of drying aggregate, a considerable amount of water is evaporated, and the hot exhaust gases in the drum mixer contain from 10% to as much as 35% steam or water vapor. The "light ends" which are stripped from the liquid asphalt upon contact with this steam appear as an oil buildup on the filter elements and walls of the baghouse and are also released through the stack, creating air pollution problems. Many light ends which remain as vapor through the baghouse condense after being exposed to low temperature air on discharge from the plant, and in extreme cases can result in oil stains forming on objects in areas around the asphalt plant. When the plant is operated with this type of process for a sufficient time, there is a high probability of fire occurring in the baghouse, because a spark from burning materials in the drum can ignite oil-soaked bags and damage or detroy the entire baghouse. In addition, the oil which forms in the baghouse can combine with dust to clog the filter elements so that air can no longer pass through, reducing plant productivity and creating difficult cleaning problems.

The degree of severity of the light end hydrocarbon problem varies with the amount of light ends in the asphalt and the amount of steam or water vapor present in the gas stream. The problem is even more severe when recycling reclaimed roadway materials, since it is necessary to use a softer virgin asphalt to compensate for the hardness in the recycle material. Softer asphalts by nature contain more light ends, thus increasing the severity of the already existing problem.

Drum mixers equipped with venturi scrubbers known to the art reduce the dust loading problems but do not correct the problem of light ends stripped from the asphalt. Conversely, the light end hydrocarbon problem can be alleviated somewhat by reducing the exposure time of the asphalt in the drum, but this reduced exposure increases the amount of airborne aggregate dust present in the exhaust. U.S. Pat. No. 4,103,350 made significant progress in the control of aggregate dust and light end emissions by providing a system which enabled a baghouse to be used to treat exhaust from a drum mixer. Formerly, drum mixers had customarily introduced liquid asphalt into the mixer as closely as possible to the aggregate inlet so that the aggregate became coated as early as possible to reduce dust emissions. However, introducing the liquid asphalt at this early stage maximized the stripping of light end hydrocarbons and caused a great deal of hydrocarbon smoke. By introducing the liquid asphalt into the drum mixer at a location farther away from the aggregate inlet to reduce smoking, a greater amount of aggregate dust became airborne. The U.S. Pat. No. 4,103,350 utilized a baghouse to treat the exhaust from the drum mixer, and the greater amount of airborne dust formed a "cake" upon the filter bags which helped to prevent the filter bags from becoming oil-soaked and further served to filter the light ends from the exhaust. However, in extreme cases, the oil would still collect heavily on the dust bags, creating the aforementioned filter-clogging problems; some light end emissions would still get through the dust "cake" on the filter bags, causing opacity problems, and there was still a potential problem with baghouse fires.

Drum dryers have been used in conjunction with pugmills in the prior art, so that liquid asphalt could be mixed with aggregate away from the heat and stream of the drum dryer. Asphalt plants described in U.S. Pat. Nos. 2,305,933 and 3,809,373 placed pugmills at separate locations away from a drum dryer. However, in those cases, it was necessary to mechanically convey the dried aggregate from the drum dryer to the remote pugmill. Efforts have also been made in the art to collect aggregate dust coming off a drum dryer by means of a "knock-out" box wherein the velocity of the air flow from the dryer decreases as it expands into the "knock-out" box and the heavier dust particles settle into the bottom of the box. Such an arrangement was contemplated by U.S. Pat. No. 4,298,287, but in that previous effort the "knock-out" box was disposed in a manner that made it necessary to mechanically convey the recovered dust back to the mixer for mixing with the liquid asphalt.

SUMMARY OF THE INVENTION

As will be seen, the invention disclosed herein overcomes these and other problems associated with the conventional drum mixer asphalt manufacturing apparatus known to the art. Stated in general terms, the asphalt plant of the present invention comprises a drum dryer, a collection chamber or "knock-out box", a conventional "baghouse", and a pugmill coater disposed directly underneath the collection chamber so that dust particles which settle out of the airstream in the collection chamber fall directly into the pugmill coater. The basic concept of the apparatus is cooperation between its elements to deal with two pollution problems: aggregate dust and light end hydrocarbons. The aggregate operates to mix the liquid asphalt and aggregate outside the dryer to avoid pollution of the gas stream moving from the dryer into the baghouse with light end hydrocarbons, which pollutants can be stripped from the liquid asphalt by the steam coming off the hot aggregate. However, since the liquid asphalt is not present in the drum dryer to help coat and control the aggregate dust, the exhaust air from the dryer is more heavily dust-laden than that from a conventional drum mixer. The collection chamber serves to compensate for the additional dust by reclaiming part of that dust and funneling it into the pugmill coater, where it is mixed with the aggregate and liquid asphalt. The remaining airborne dust is filtered through a baghouse in the conventional manner.

When it is desired to utilize reclaimed asphalt roadway material in conjunction with virgin aggregate in the manufacturing process, the recycle material can be admitted into the drum dryer at an intermediate point sufficiently removed from the heat source not to cause excessive smoking. Since it is known that light end hydrocarbons evaporate from asphaltic material within twelve months of its manufacture, the recycle material generally contains no light ends and can safely be exposed to the steam of the drum dryer. In this manner, the recycled material can be heated by burner gases within the drum, and the recycle and virgin aggregate can be premixed prior to dropping into the coater where they both meet with the liquid asphalt.

By positioning the "knock-out" box or collection chamber so that dust particles collected in the chamber fall directly into the pugmill by force of gravity, the necessity of having to mechanically convey these dust particles back to the collection chamber is obviated. A protective shield can optionally be positioned in the bottom of the collection chamber to further isolate the liquid asphalt from the steam being exhausted from the drum dryer. The shield is disposed so that dust particles dropping within the collection housing above the pugmill coater will slide down the shield into the pugmill.

Thus, it is an object of the present invention to provide an improved apparatus for the manufacture of asphalt aggregate material.

Another object of this invention is to provide an apparatus for the manufacture of asphalt aggregate material which minimizes the stripping of light-end hydrocarbons from the liquid asphalt used in the mixing process, thereby avoiding the problems of oil accumulation in baghouses, baghouse fires, and opacity problems that result in failure to meet air pollution codes.

It is also an object of this invention to provide an apparatus for the manufacture of asphalt aggregate material which reclaims a portion of the airborne dust particles exhausted in the drying process and returns the dust particles to the manufacturing process, relieving the load on the baghouse.

It is a further object of this invention to provide an apparatus which permits the utilization of reclaimed asphalt roadway material which is being recycled in the manufacture of new asphalt aggregate material.

Other objects, features and advantages of the present invention will become apparent upon reading the following specifications when taken in conjunction with the drawing and the appended claims.

DETAILED DESCRIPTION OF THE INVENTION

Figure 1:
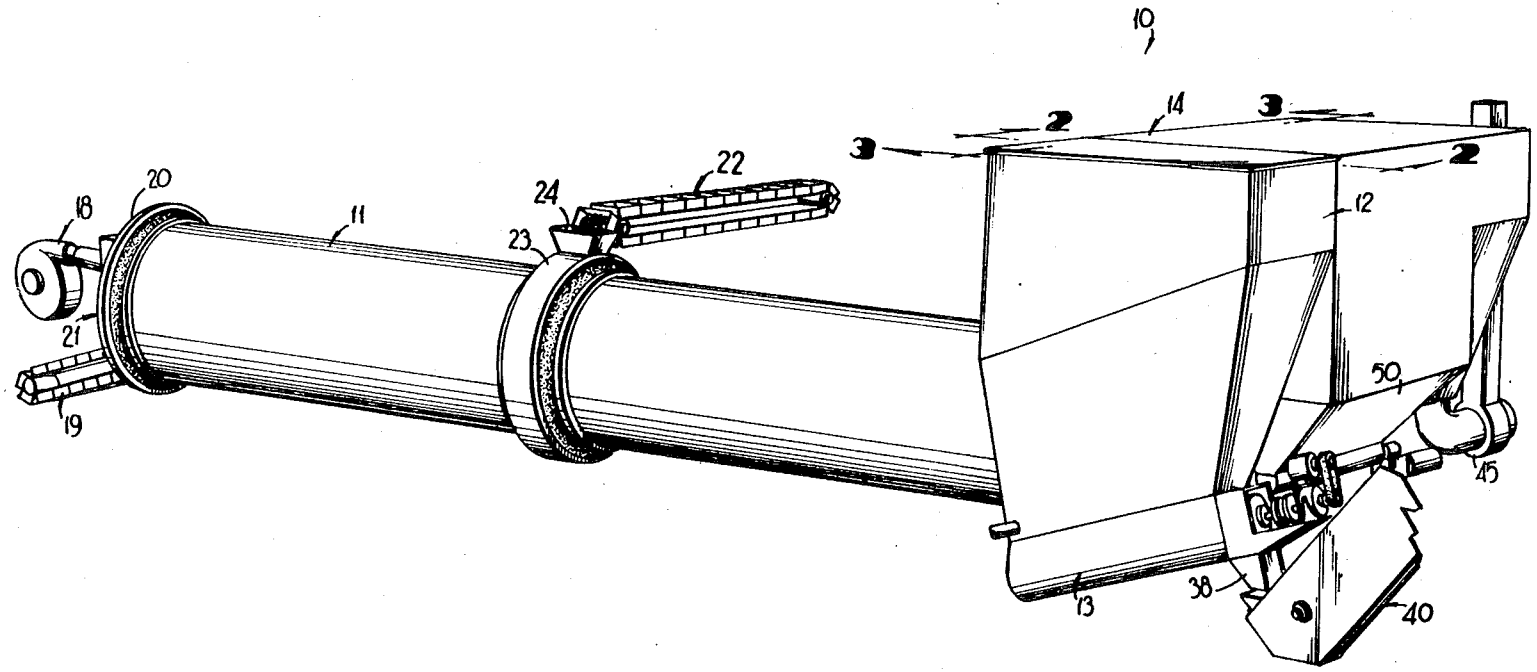
FIG. 1 shows an overall pictorial view of an asphalt plant apparatus according to the disclosed embodiment of the present invention.

Referring now in more detail to the drawing in which like numerals represent like parts throughout the several views, FIGS. 1–5 show an asphalt plant 10 embodying the principles of the present invention, and including a drum dryer 11, a collection housing 12, a pugmill coater 13, and a fiber filter dust collection system known to those skilled in the art as a "baghouse" 14. The drum dryer 11 is mounted with its longitudinal axis sloping with respect to horizontal in a manner known to those skilled in the art and has a fuel-fired burner 18 mounted at the upper end 20 of the drum dryer 11 to heat the interior of the dryer. Aggregate material is introduced by a conveyor 19 to the upper end 20 of the drum dryer 11 through an inlet 21 in the conventional manner. Similarly, reclaimed asphalt roadway material that is being recycled is conveyed by conveyor 22 and introduced to a midpoint 23 of the drum dryer 11 through another inlet 24 in the conventional manner. It should be understood that the aggregate conveyor 19 is preceded by aggregate material storage screening and weighing apparatus which form no part of the present invention, and that the recycled material conveyor 22 is similarly preceded by storage, screening, and weighing apparatus which also form no part of the present invention. It should also be understood that the drum dryer 11 is supported and rotationally driven by drive means 26, shown in FIG. 4, which is commonly known to the art and which forms no part of the present invention.

Figure 2:
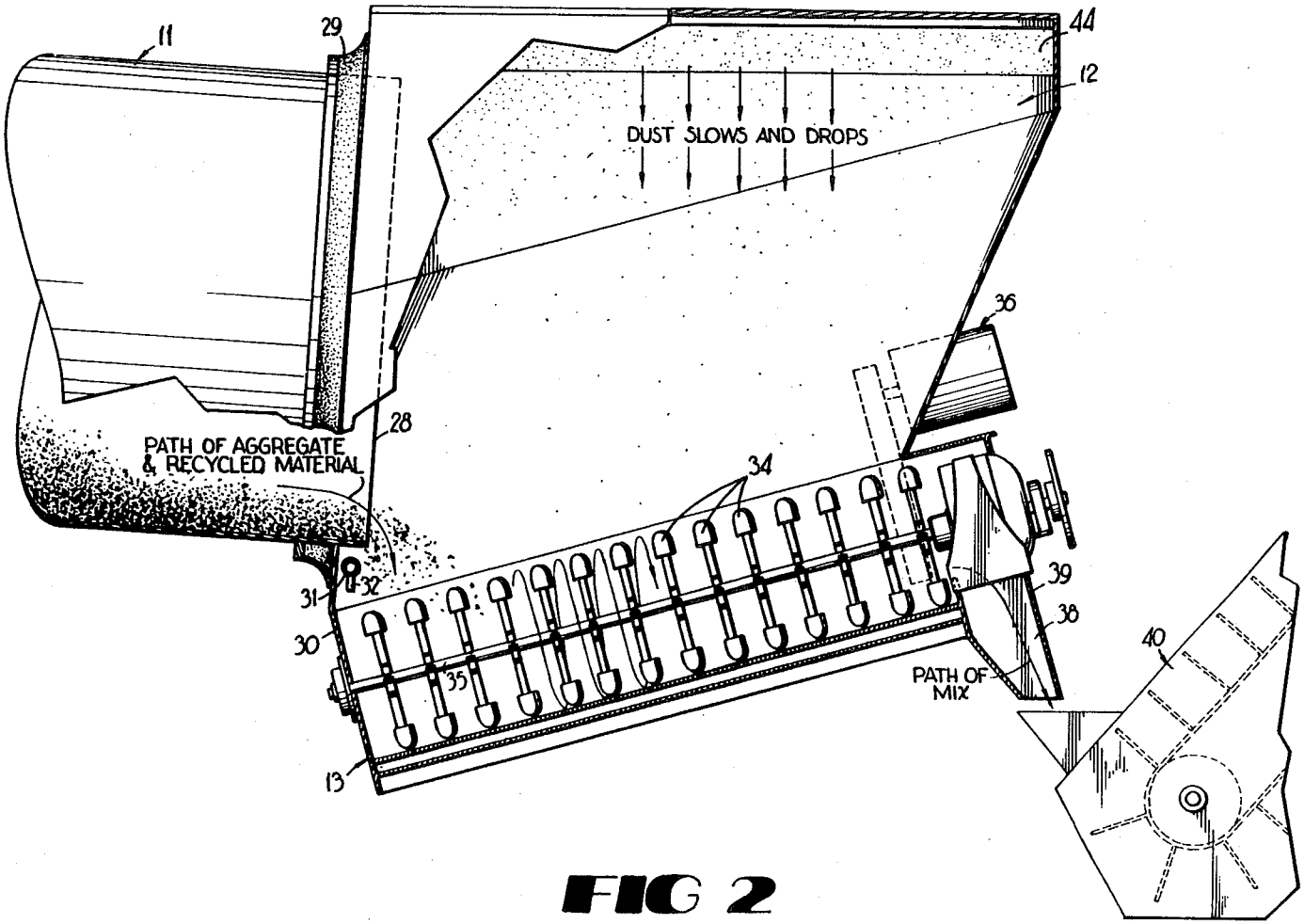
FIG. 2 shows a partial side cross sectional view of the collection housing and pugmill coater taken along line 2—2 of FIG. 1.

FIG. 2 shows the lower or outlet end 28 of the drum dryer 11 being received for rotation within the collection housing 12, which provides a chamber for exhaust dust laden air from drum dryer 11. Gasket 29 forms a seal between the drum dryer 11 and the collection housing 12 to minimize air leakage between these two components. The pugmill coater 13 is mounted directly underneath the collection housing 12 with its longitudinal axis sloping with respect to horizontal. The lower end 30 of the pugmill coater 13 is disposed directly underneath the outlet end 28 of the drum dryer 11 so that dried aggregate from the drum dryer falls by gravity directly into the pugmill coater. Optionally, mineral fines can be introduced into the pugmill coater 13 along with the dried aggregate at the lower end 30 of the pugmill coater. The fines can be conveyed in a conventional manner to join a dust return line 58 described below. Conventional apparatus (not shown) for heating and conveying liquid asphalt to the pugmill coater through a supply line 31 is provided. A spray nozzle 32 at the end of the line 31 mounted proximate to the lower end 30 of the pugmill coater 13 sprays the dried aggregate with liquid asphalt as it falls into the pugmill coater. Aggregate dust particles which fall from the exhaust air in the collection housing 12 fall directly into the pugmill coater 13. A plurality of paddles 34 are spirally configured about a shaft 35 which is mounted for rotation along the longitudinal axis of the pugmill coater 13 and rotationally driven by conventional drive means 36. A discharge outlet 38 at the upper end 39 of the pugmill coater 13 discharges the contents of the pugmill coater onto discharge conveyor 40. It should be understood that discharge conveyor 40 is succeeded by a surge bin, known to the art, from which the contents of the pugmill coater are weighed and discharged onto trucks in the conventional manner, which apparatus form no part of the present invention.

Figure 7:
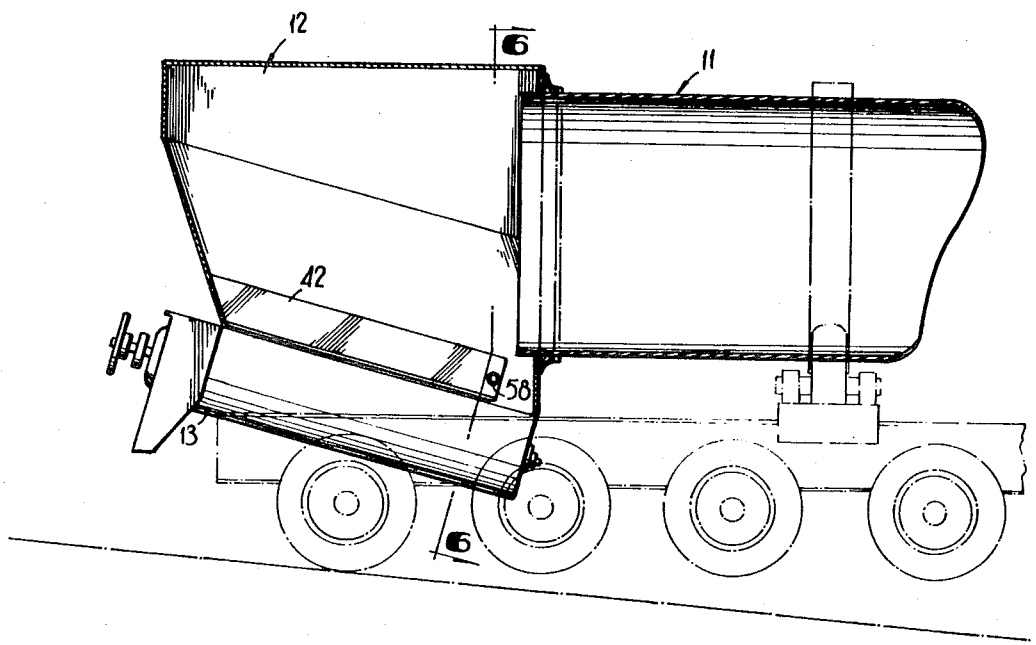
FIG. 7 shows a side section view of the optional embodiment shown in FIG. 6.
Figure 6:
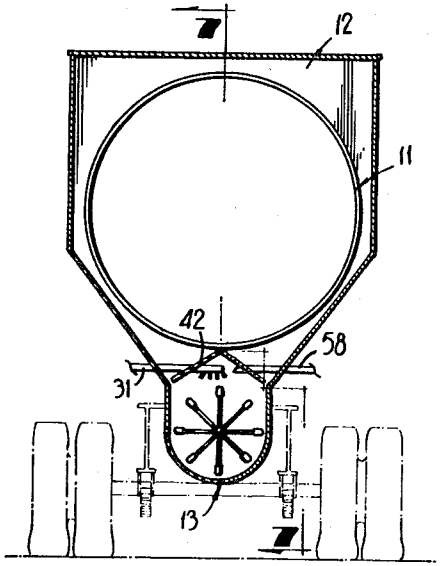
FIG. 6 shows an end section view of an alternate embodiment of the collection housing shown in FIG. 1 incorporating a protective shield mounted over the pugmill coater.

FIGS. 6 and 7 show an optional shield 42 mounted in the collection housing 12 over the pugmill coater 13, which additionally isolates the liquid asphalt from the steam being exhausted out of the drum dryer 11 through the collection housing 12. The shield 42 is longitudinally disposed just above and substantially parallel to the longitudinal axis of the pugmill coater 13. The lateral cross section of the shield 42 is shaped like an inverted V, and the shield can be slightly wider and longer than the opening over the pugmill coater 13. However, space is allowed for dust falling on the shield 42 to fall off the side edges of the shield onto the sloping walls of the housing 12 and down into the coater 13. The lines 31 and 58 for liquid asphalt and returned dust from the baghouse pass through openings in the shield 42.

An air passage 44 connects the collection housing 12 to the baghouse 14. Located at the opposite end of the baghouse 14 is an exhaust fan 45 which draws air from the upper end 20 of the drum dryer 11, through the interior of the drum dryer, out the lower end 28 of the drum dryer, through the collection housing 12, through the air passage 44, and through the baghouse 14 to the ambient atmosphere.

Figure 3:
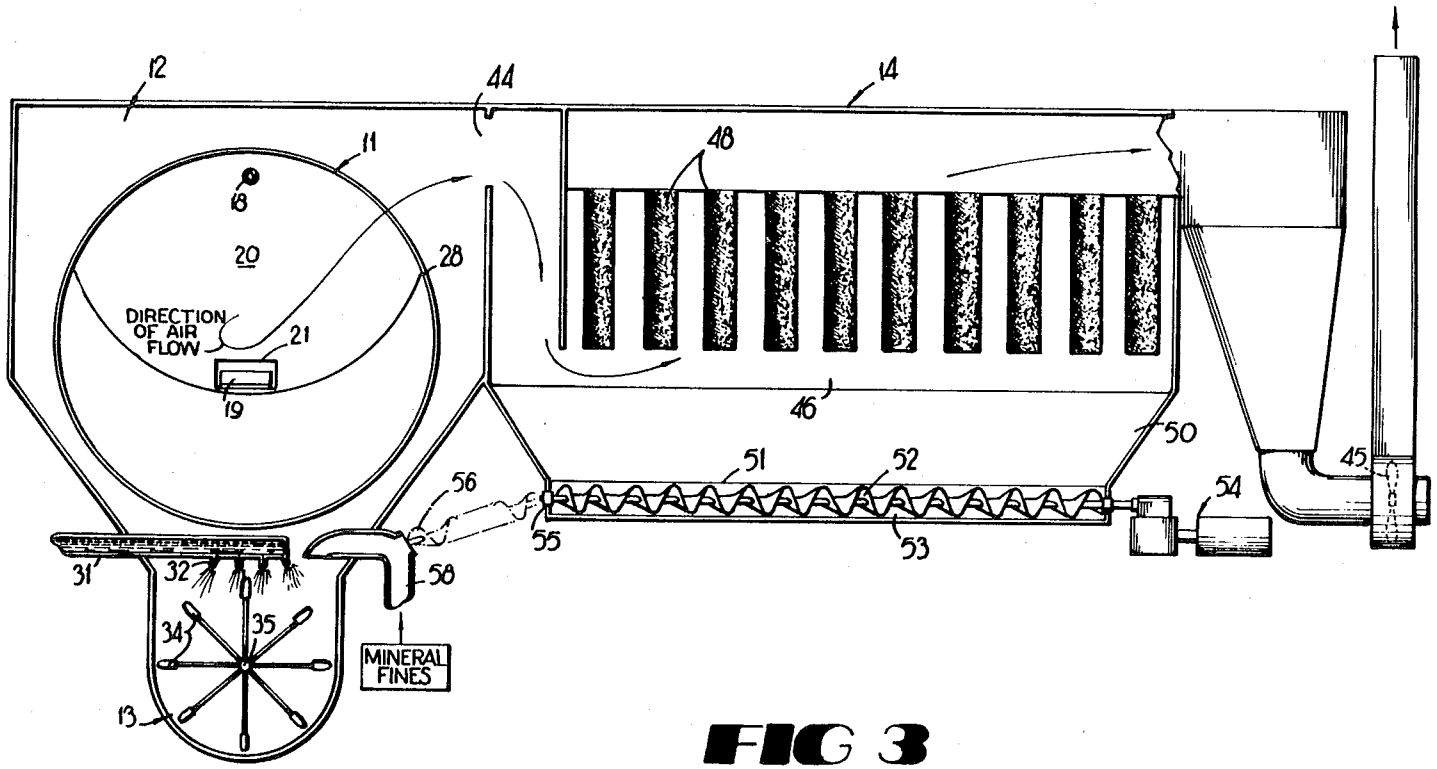
FIG. 3 shows a schematic longitudinal cross sectional view of the baghouse, collection housing and pugmill coater taken along line 3—3 of FIG. 1.

Referring now to FIG. 3, the baghouse 14 has an internal filter chamber 46 within which extend a number of fiber filter collectors in the form of filter bags 48. The filter chamber 46 is positioned above a dust collection chamber 50 which takes the shape of a generally V-shaped trough having a narrow end 51 opening into a screw auger 52 which is rotatably contained within an auger chamber 53 extending along the length of the dust collection chamber 50. The auger 52 is rotated by a conventional drive apparatus 54 to carry dust particles toward the auger outlet 55. An inclined screw conveyor, shown schematically at 56, transfers the recovered dust from the dust collection chamber 50 the pugmill coater 13. The recovered dust is then introduced into the pugmill coater by way of the dust return conduit 58, which delivers the dust at a location adjacent to the liquid asphalt spray 32.

It will be appreciated by those skilled in the art that alternative means for conveying the recovered dust from the baghouse to the pugmill coater may be provided, such as a blower for creating a moving airstream through a dust return conduit, and a rotary airlock to meter the recovered dust from the dust collection chamber into the airstream to carry it through the conduit to the pugmill coater for reintroduction into the manufacturing process.

Figure 4:
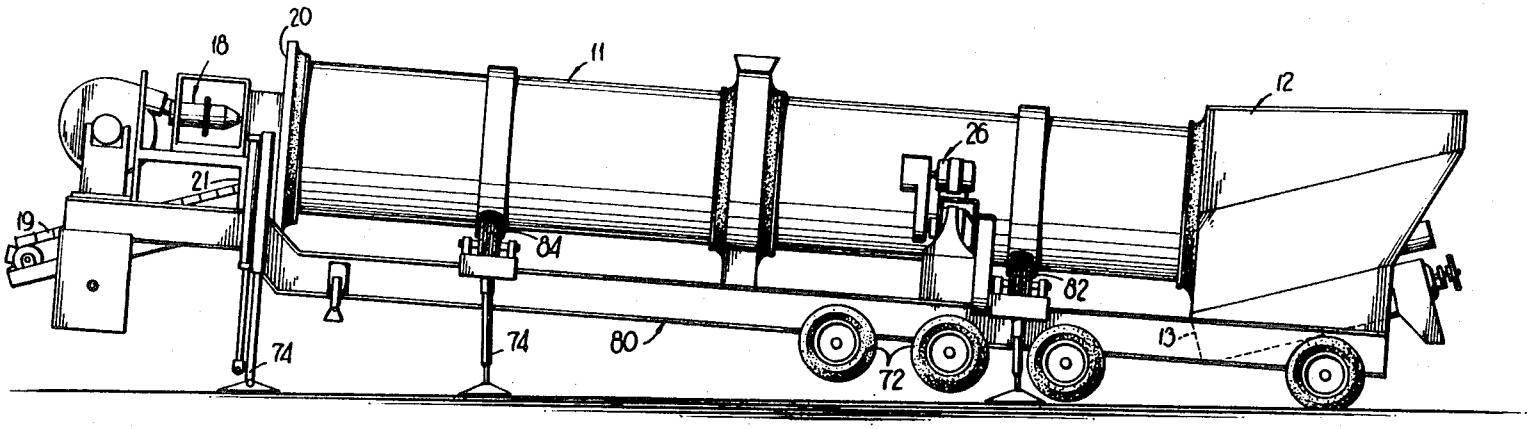
FIG. 4 shows a side plan view of a drum dryer, collection housing, and pugmill coater mounted on a trailer for transportability.
Figure 5:
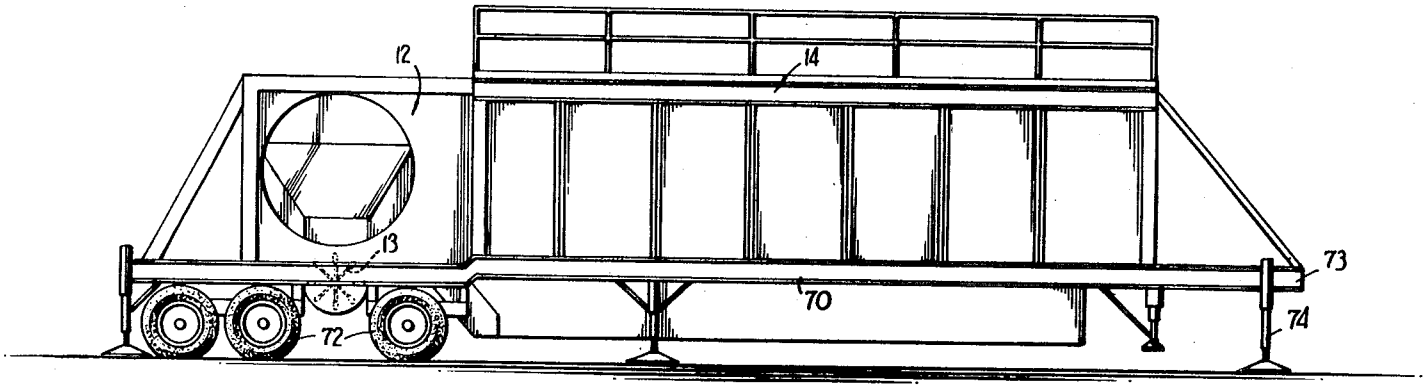
FIG. 5 shows a side plan view of a collection housing and baghouse mounted on a trailer for transportability.

The asphalt plant apparatus 10 can be portably mounted in sections for transportation between job locations. FIG. 5 shows the collection housing 12, pugmill coater 13, and baghouse 14 mounted as a single unit on trailer frame 70, with wheels 72 and trailer hitch 73 which enable the unit to be attached to a conventional truck for towing to the job location, where adjustable stabilizer legs 74 are employed to support and stabilize the unit. FIG. 4 shows an alternate configuration with the drum dryer 11 mounted for rotation on trailer frame 80 by means of drive wheels 82 and idler wheels 84. The collection housing 12 and pugmill coater are mounted on the trailer 80 with the drum dryer 11. The frame 80 is mounted on wheels 72 and stabilizer legs 74 as previously explained, said adjustable stabilizer legs further serving to tilt the longitudinal axis of the drum dryer with respect to horizontal as hereinbefore explained. Other components of the asphalt plant, not shown, such as the various conveyors, storage bins, liquid asphalt storage tank, and control booth, are similarly mounted on trailers for ease of transportation and convenient assembly at the job site. It should be understood that the collection housing can be mounted on one trailer as a single unit with either the baghouse or the dryer, with the other major component comprising a separate unit on a second trailer if desired.

Considering the operation of the described embodiment of the present asphalt plant, aggregate material is introduced into the upper end 20 of the drum dryer 11 through the inlet 21, where the fuel fired burner 18 heats the interior of the drum dryer. The rotation of the drum dryer 11 agitates the aggregate in the flow of heated air, drying the aggregate. To avoid the excessive smoke caused when recycle material is exposed to high temperatures such as those at the upper end 20 of the drum dryer 11, recycle material is introduced through inlet 24 at midpoint 23 of the drum dryer. As the combined dried aggregate and recycled material are discharged from the outlet end 28 of the drum dryer 11 and fall into the pugmill coater 13, they are sprayed with liquid asphalt from the spray nozzle 32 mounted at the lower end 30 of the pug-mill coater 13.

The negative pressure created by the exhaust fan 45 creates an air flow through the drum dryer 11 of approximately 1000 feet per minute. As the aggregate and recycle material are heated within the drum dryer 11, steam and aggregate dust are created. Since exposure to steam tends to strip light end hydrocarbons from liquid asphalt, creating unwanted pollutants, no liquid asphalt is introduced at this point in the apparatus. However, since there is no liquid asphalt in the drum dryer 11 to coat the aggregate dust, a greater than usual amount of aggregate dust becomes airborne. As the airflow from the drum dryer 11 is pumped out the outlet end 28 of the drum dryer, the airflow, carrying the airborne aggregate dust particles, enters the collection housing 12. The airflow experiences an increased cross sectional area resulting in a decrease in a flow rate of the gases to approximately 500 feet per minute. As the decreased flow rate can no longer maintain the aggregate dust in suspension, the larger dust particles drop downwardly into the pugmill coater 13. The paddles 34 within the pug- mill coater 13 mix the aggregate, recycle material, dust, and liquid asphalt thoroughly and urge the mix towards the exit end 39 of the pugmill coater, where it is discharged through discharge outlet 38.

In embodiments utilizing the optional shield 42 mounted in the collection housing 12 located over the pugmill coater 13, the shield 42 is positioned so as to intervene between the steam-laden exhaust air flow and the liquid asphalt in the pugmill coater, thus affording further insurance against any stripping of light end hydrocarbons from the liquid asphalt by contact with steam. The larger particles of aggregate dust which fall out of the exhaust air flow fall onto the top surface of the shield 42, which is slanted downwardly on either side of its center line in such a manner that the dust particles slide down into the pugmill coater 13 by force of gravity.

The exhaust air flow and suspended particulate matter are withdrawn from the collection housing 12 through air passage 44 under influence of the negative pressure produced at the head end of the baghouse 14 by operation of the exhaust fan 45. The suspended particulate matter is collected on the outside surfaces of the filter bags 48 within the baghouse 14 in the conventional manner to form a "cake" of dust as air passes through the porous fiber material of the filter bags. This cake of dust is periodically removed from the filter bags 48 by merely reversing the flow of air through the bags in a manner known to those skilled in art, so that the dust cake is literally blown off the bags to drop downwardly into the dust collection chamber 50. The dust cake is then carried by the augur 52 to the inclined screw conveyor 56, which conveys the recovered dust to the pugmill coater 13. The dust is reintroduced into the lower end 30 of the pugmill coater by way of dust return conduit 58, where the readmitted dust is coated with liquid asphalt and cannot again become airborne.

Finally it will be understood that the preferred embodiments of the present invention have been disclosed by way of example and that other modifications may occur to those skilled in the art without departing from the scope and spirit of the appended claims.

What is claimed is:

1. An apparatus for manufacturing asphalt paving composition, comprising:

a rotary drum having upper and lower ends;

means for introducing aggregate into the upper end of said rotary drum;

means for heating the interior of said rotary drum, whereby said aggregate introduced into the upper end of said rotary drum is dried and heated as it travels through said rotary drum;

mixing means;

means for introducing said heated aggregate from the lower end of said rotary drum into said mixing means;

exhaust means for creating an exhaust airflow through and out of said rotary drum, whereby airborne particulate matter generated by the drying and heating of said aggregate is extracted from the interior of said rotary drum in said exhaust airflow;

collection means for causing a portion of said particulate matter suspended in said exhaust airflow to drop out of said exhaust airflow into said mixing means, whereby said portion of said particulate matter is recovered from said exhaust airflow; and means for introducing liquid asphalt into said mixing means, whereby said aggregate is dried and heated in said rotary drum and mixed with said recovered particulate matter and said liquid asphalt in said mixing means to form an asphalt paving composition.

2. The apparatus of claim 1 wherein said collection means for causing said particulate matter suspended in said exhaust airflow to drop out of said exhaust airflow into said mixing means comprises a knock-out box disposed directly above said mixing means and through which said exhaust airflow is directed, whereby said exhaust airflow is slowed upon entering said knock-out box, causing said portion of said particulate matter suspended in said exhaust airflow to drop out of said exhaust airflow into said mixing means.

3. The apparatus of claim 1, further comprising means for introducing recycled asphalt product into said rotary drum, whereby said recycled asphalt product is heated and mixed with said aggregate and discharged into said mixing means.

* * * * *